US011111728B2

(12) United States Patent
Bowes

(10) Patent No.: US 11,111,728 B2
(45) Date of Patent: Sep. 7, 2021

(54) SUPER HARD CONSTRUCTIONS AND METHODS OF MAKING SAME

(71) Applicant: ELEMENT SIX (UK) LIMITED, Didcot (GB)

(72) Inventor: David Christian Bowes, Didcot (GB)

(73) Assignee: Element Six (UK) Limited, Didcot (GB)

( * ) Notice: Subject to any disclaimer, the term of this patent is extended or adjusted under 35 U.S.C. 154(b) by 0 days.

(21) Appl. No.: 16/066,469

(22) PCT Filed: Dec. 19, 2016

(86) PCT No.: PCT/EP2016/081679

§ 371 (c)(1),
(2) Date: Jun. 27, 2018

(87) PCT Pub. No.: WO2017/114678

PCT Pub. Date: Jul. 6, 2017

(65) Prior Publication Data

US 2019/0017330 A1 Jan. 17, 2019

(30) Foreign Application Priority Data

Dec. 31, 2015 (GB) ..... 1523149

(51) Int. Cl.
*E21B 10/08* (2006.01)
*E21B 10/573* (2006.01)
(Continued)

(52) U.S. Cl.
CPC ..... *E21B 10/08* (2013.01); *B22F 1/0014* (2013.01); *B22F 3/1103* (2013.01); *B22F 7/008* (2013.01);
(Continued)

(58) Field of Classification Search
CPC .... E21B 10/08; E21B 10/5735; B22F 1/0014; B22F 3/1103; B22F 7/008; B22F 7/062; C22C 26/00
See application file for complete search history.

(56) References Cited

U.S. PATENT DOCUMENTS 5,662,720 A * 9/1997 O'Tighearnaigh ..... B22F 7/06 51/295
5,862,873 A * 1/1999 Matthias ..... E21B 10/5735 175/432
(Continued)

FOREIGN PATENT DOCUMENTS

EP 0691167 A1 1/1996
EP 1527251 A1 5/2005
(Continued)

OTHER PUBLICATIONS

United Kingdom Patent Application No. GB1523149.1, Combined Search and Examination Report dated Oct. 5, 2016, 7 pages.
(Continued)

*Primary Examiner* — Matthew R Buck
(74) *Attorney, Agent, or Firm* — Dean W. Russell; Clark F. Weight; Kilpatrick Townsend & Stockton LLP

(57) ABSTRACT

A super hard construction comprises a substrate comprising a peripheral surface, an interface surface and a longitudinal axis extending in a plane and a super hard material layer formed over the substrate and having an exposed outer surface, a peripheral surface extending therefrom and an interface surface. One of the interface surface of the substrate or the interface surface of the super hard material layer comprises one or more projections arranged to project from the interface surface, the one or more projections being spaced from the peripheral surface of the substrate and a peripheral flange extending between the peripheral side edge and the interface surface. The peripheral flange is inclined at
(Continued)

an angle of between around 5 degrees to around 30 degrees to a plane substantially perpendicular to the plane through which the longitudinal axis extends.

17 Claims, 2 Drawing Sheets

(51) Int. Cl.

| | |
|---|---|
| ***C22C 26/00*** | (2006.01) |
| ***B22F 1/00*** | (2006.01) |
| ***B22F 3/11*** | (2006.01) |
| ***B22F 7/00*** | (2006.01) |
| ***B22F 7/06*** | (2006.01) |
| *B22F 5/00* | (2006.01) |

(52) U.S. Cl.
CPC ..... *B22F 7/062* (2013.01); *C22C 26/00* (2013.01); *E21B 10/5735* (2013.01); *B22F 2005/001* (2013.01); *B22F 2005/005* (2013.01); *B22F 2302/253* (2013.01); *B22F 2302/406* (2013.01)

(56) References Cited

U.S. PATENT DOCUMENTS 5,906,246 A * 5/1999 Mensa-Wilmot ..... B23B 27/146 175/432
6,041,875 A * 3/2000 Rai ..... E21B 10/5735 175/426
6,082,474 A * 7/2000 Matthias ..... E21B 10/5735 175/432
6,571,891 B1 * 6/2003 Smith ..... E21B 10/567 175/428
6,733,378 B1 * 5/2004 Tank ..... E21B 10/5735 175/428
2011/0120782 A1 * 5/2011 Cooley ..... B24D 99/005 175/432
2014/0087640 A1 * 3/2014 Morozov ..... B24D 7/18 451/548
2014/0262546 A1 * 9/2014 Flood ..... B24D 18/00 175/432

FOREIGN PATENT DOCUMENTS

GB 2337543 A 11/1999
WO 2004007901 A1 1/2004
WO 2014191555 A2 12/2014

OTHER PUBLICATIONS

United Kingdom Patent Application No. GB1621556.8, Combined Search and Examination Report dated Jan. 11, 2017, 7 pages.
International Patent Application No. PCT/EP2016/081679, International Search Report and Written Opinion dated Mar. 21, 2017, 12 pages.

* cited by examiner

SUPER HARD CONSTRUCTIONS AND METHODS OF MAKING SAME

FIELD

This disclosure relates to super hard constructions and methods of making such constructions, particularly but not exclusively to constructions comprising polycrystalline diamond (PCD) structures attached to a substrate and for use as cutter inserts or elements for drill bits for boring into the earth.

BACKGROUND

Polycrystalline super hard materials, such as polycrystalline diamond (PCD) and polycrystalline cubic boron nitride (PCBN) may be used in a wide variety of tools for cutting, machining, drilling or degrading hard or abrasive materials such as rock, metal, ceramics, composites and wood-containing materials. In particular, tool inserts in the form of cutting elements comprising PCD material are widely used in drill bits for boring into the earth to extract oil or gas. The working life of super hard tool inserts may be limited by fracture of the super hard material, including by spalling and chipping, or by wear of the tool insert.

Cutting elements such as those for use in rock drill bits or other cutting tools typically have a body in the form of a substrate which has an interface end/surface and a super hard material which forms a cutting layer bonded to the interface surface of the substrate by, for example, a sintering process. The substrate is generally formed of a tungsten carbide-cobalt alloy, sometimes referred to as cemented tungsten carbide and the super hard material layer is typically polycrystalline diamond (PCD), polycrystalline cubic boron nitride (PCBN) or a thermally stable product TSP material such as thermally stable polycrystalline diamond.

Polycrystalline diamond (PCD) is an example of a super hard material (also called a superabrasive material) comprising a mass of substantially inter-grown diamond grains, forming a skeletal mass defining interstices between the diamond grains. PCD material typically comprises at least about 80 volume % of diamond and is conventionally made by subjecting an aggregated mass of diamond grains to an ultra-high pressure of greater than about 5 GPa, and temperature of at least about 1,200° C., for example. A material wholly or partly filling the interstices may be referred to as filler or binder material.

PCD is typically formed in the presence of a sintering aid such as cobalt, which promotes the inter-growth of diamond grains. Suitable sintering aids for PCD are also commonly referred to as a solvent-catalyst material for diamond, owing to their function of dissolving, to some extent, the diamond and catalysing its re-precipitation. A solvent-catalyst for diamond is understood be a material that is capable of promoting the growth of diamond or the direct diamond-to-diamond inter-growth between diamond grains at a pressure and temperature condition at which diamond is thermodynamically stable. Consequently the interstices within the sintered PCD product may be wholly or partially filled with residual solvent-catalyst material. Most typically, PCD is often formed on a cobalt-cemented tungsten carbide substrate, which provides a source of cobalt solvent-catalyst for the PCD. Materials that do not promote substantial coherent intergrowth between the diamond grains may themselves form strong bonds with diamond grains, but are not suitable solvent—catalysts for PCD sintering.

Cemented tungsten carbide which may be used to form a suitable substrate is formed from carbide particles being dispersed in a cobalt matrix by mixing tungsten carbide particles/grains and cobalt together then heating to solidify. To form the cutting element with a super hard material layer such as PCD or PCBN, diamond particles or grains or CBN grains are placed adjacent the cemented tungsten carbide body in a refractory metal enclosure such as a niobium enclosure and are subjected to high pressure and high temperature so that inter-grain bonding between the diamond grains or CBN grains occurs, forming a polycrystalline super hard diamond or polycrystalline CBN layer.

In some instances, the substrate may be fully cured prior to attachment to the super hard material layer whereas in other cases, the substrate may be green, that is, not fully cured. In the latter case, the substrate may fully cure during the HTHP sintering process. The substrate may be in powder form and may solidify during the sintering process used to sinter the super hard material layer.

Cobalt has a significantly different coefficient of thermal expansion from that of diamond and, as such, upon heating of the polycrystalline diamond material during use, the cobalt in the substrate to which the PCD material is attached expands and may cause cracks to form in the PCD material, resulting in the deterioration of the PCD layer.

To reduce the residual stresses created at the interface between the substrate and the super hard layer, interface surfaces on substrates are known to have been formed with a plurality concentric annular rings projecting from the planar interface surface. Due to the difference in the coefficients of thermal expansion of the substrate and the super hard material layer, these layers contract at different rates when the cutting element is cooled after HTHP sintering. Tensile stress regions are formed on the upper surfaces of the rings, whereas compressive stress regions are formed on/in the valleys between such rings. Consequently, when a crack begins to grow in use, it may grow annularly along the entire upper surface of the annular ring where it is exposed to tensile stresses, or may grow along the entire annular valley between the projecting rings where it is exposed to compressive stresses, leading to the early failure of the cutting element.

It is also known for cutting element substrate interfaces to comprise a plurality of spaced apart projections, the projections having relatively flat upper surfaces projecting from a planar interface surface.

Common problems that affect cutting elements are chipping, spalling, partial fracturing, and cracking of the super hard material layer. Another problem is cracking along the interface between the super hard material layer and the substrate and the propagation of the crack across the interface surface. These problems may result in the early failure of the super hard material layer and thus in a shorter operating life for the cutting element. Accordingly, there is a need for a cutting element having an enhanced operating life in high wear or high impact applications, such as boring into rock, with a super hard material layer in which the likelihood of cracking, chipping, and fracturing is reduced or controllable.

SUMMARY

Viewed from a first aspect there is provided a super hard construction comprising:

a substrate comprising a peripheral surface, an interface surface and a longitudinal axis extending in a plane; and a super hard material layer formed over the substrate and having an exposed outer surface, a peripheral surface extending therefrom and an interface surface;

wherein one of the interface surface of the substrate or the interface surface of the super hard material layer comprises:

one or more projections arranged to project from the interface surface; the one or more projections being spaced from the peripheral surface of the substrate; and a peripheral flange extending between the peripheral side edge and the interface surface, the peripheral flange being inclined at an angle of between around 5 degrees to around 30 degrees to a plane substantially perpendicular to the plane through which the longitudinal axis extends.

Viewed from a second aspect there is provided an earth boring drill bit comprising a body having the aforementioned super hard construction mounted thereon as a cutter element.

BRIEF DESCRIPTION OF THE DRAWINGS

Non-limiting examples will now be described by way of example and with reference to the accompanying drawings in which.

DETAILED DESCRIPTION

In the examples described herein, when projections or depressions are described as being formed on the substrate surface, it should be understood that they could be formed instead on the surface of the super hard material layer that interfaces with the substrate interface surface, with the inverse features formed on the substrate. Additionally, it should be understood that a negative or reversal of the interface surface is formed on the super hard material layer interfacing with the substrate such that the two interfaces form a matching fit.

As used herein, a "super hard material" is a material having a Vickers hardness of at least about 28 GPa. Diamond and cubic boron nitride (cBN) material are examples of super hard materials.

As used herein, a "super hard construction" means a construction comprising a body of polycrystalline super hard material and a substrate attached thereto.

As used herein, polycrystalline diamond (PCD) is a type of polycrystalline super hard material (PCS) material comprising a mass of diamond grains, a substantial portion of which are directly inter-bonded with each other and in which the content of diamond is at least about 80 volume percent of the material. In one example of PCD material, interstices between the diamond grains may be at least partly filled with a binder material comprising a catalyst for diamond. As used herein, "interstices" or "interstitial regions" are regions between the diamond grains of PCD material. In examples of PCD material, interstices or interstitial regions may be substantially or partially filled with a material other than diamond, or they may be substantially empty. PCD material may comprise at least a region from which catalyst material has been removed from the interstices, leaving interstitial voids between the diamond grains.

As used herein, PCBN (polycrystalline cubic boron nitride) material refers to a type of super hard material comprising grains of cubic boron nitride (cBN) dispersed within a matrix comprising metal or ceramic. PCBN is an example of a super hard material.

A "catalyst material" for a super hard material is capable of promoting the growth or sintering of the super hard material.

The term "substrate" as used herein means any substrate over which the super hard material layer is formed. For example, a "substrate" as used herein may be a transition layer formed over another substrate. Additionally, as used herein, the terms "radial" and "circumferential" and like terms are not meant to limit the feature being described to a perfect circle.

The super hard construction 1 shown in the attached figures may be suitable, for example, for use as a cutter insert for a drill bit for boring into the earth.

Like reference numbers are used to identify like features in all drawings.

Figure 1:
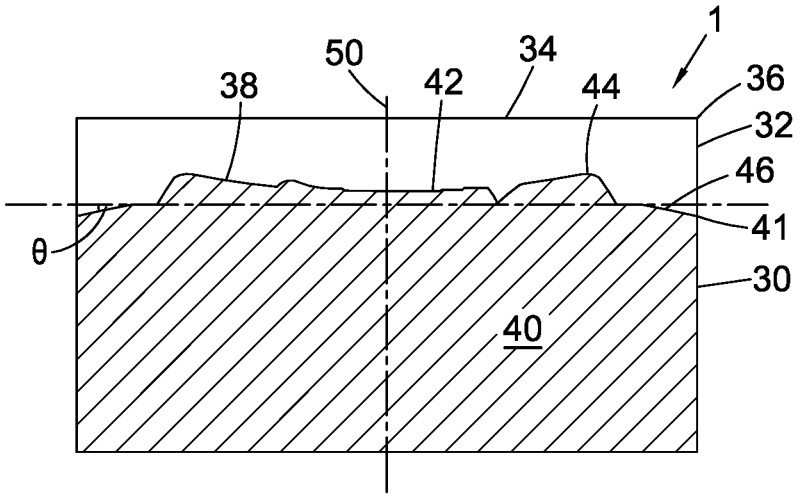
FIG. 1 is a schematic cross-sectional view of an example of a cutting element showing the interface substrate features between the substrate and body of superhard material in phantom.

In an example as shown in FIG. 1, a cutting element 1 includes a substrate 30 with a layer of super hard material 32 formed on the substrate 30. The substrate may be formed of a hard material such as cemented tungsten carbide. The super hard material may be, for example, polycrystalline diamond (PCD), polycrystalline cubic boron nitride (PCBN), or a thermally stable product such as thermally stable PCD (TSP). The cutting element 1 may be mounted into a bit body such as a drag bit body (not shown). The exposed top surface of the super hard material opposite the substrate forms the cutting face 34, which is the surface which, along with its edge 36, performs the cutting in use.

At one end of the substrate 30 is an interface surface 38 that interfaces with the super hard material layer 32 which is attached thereto at this interface surface. The substrate 30 is generally cylindrical and has a peripheral surface 40, a peripheral side edge 41, and a first surface 42 having one or more surface features 44.

Figure 2:
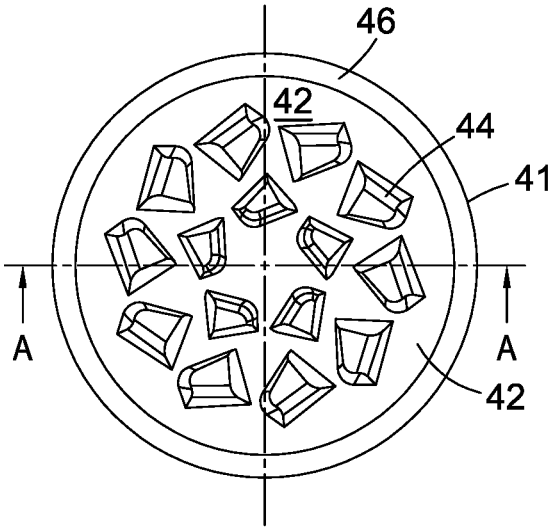
FIG. 2 is a schematic plan view of the substrate of FIG. 1 according to a first example.

In the example shown in FIGS. 1 and 2, the interface surface 38 includes an inclined flange 46 which extends from the peripheral surface 40 of the substrate 30 at the peripheral side edge 41, to the first surface 42. The first surface 42 comprises a substantially planar main portion from which the plurality of spaced-apart projections 44 extend, the projections being spaced from the peripheral edge 41. The flange 46 is inclined at an angle θ of between around 5 to around 20 degrees to the plane perpendicular to the plane through which the longitudinal axis 50 of the cutting element 1 extends. In some examples, the length of the flange 46 from the peripheral side edge 41 to the first surface 42 is between around 0.1 to around 1 mm, and in some examples is around 0.35 mm.

Figure 3:
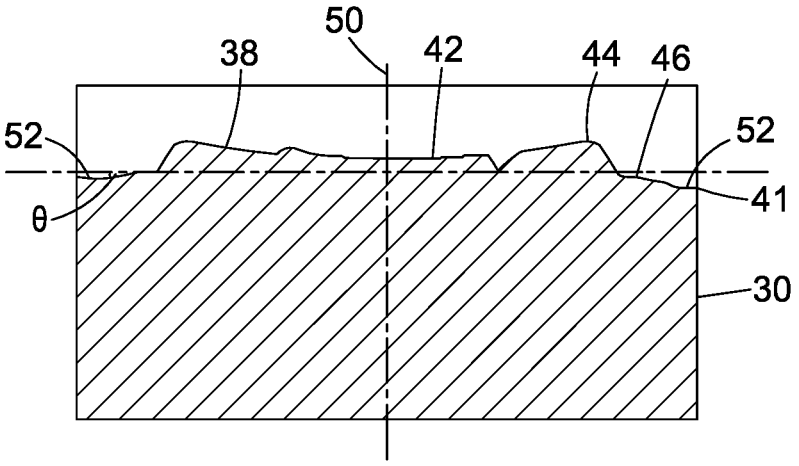
FIG. 3 a schematic cross-sectional view of a further example of a cutting element showing the interface substrate features between the substrate and body of superhard material in phantom.
Figure 4:
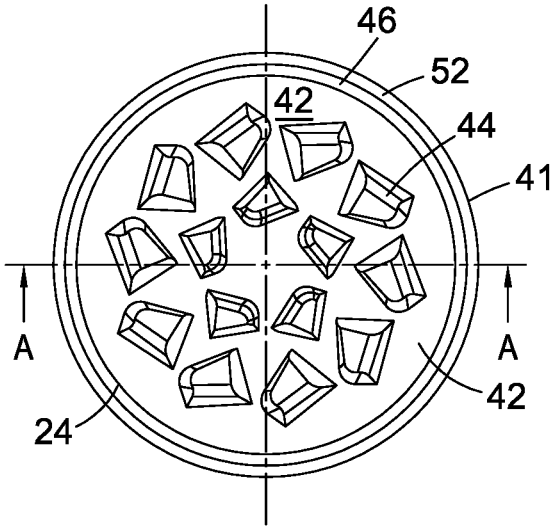
FIG. 4 is a schematic plan view of the substrate of the substrate of FIG. 3.

A second example is shown in FIGS. 3 and 4 and this example differs from that shown in FIGS. 1 and 2 in that the flange 46 is spaced from the peripheral side surface 40 by a shoulder 52. In some examples, the radial length of the shoulder 52 from the peripheral side edge 41 to the flange 46 is between around 0.2 to around 0.8 mm, and in some examples is between around 0.3 mm to around 0.5 mm. In this example, the angle θ at which the flange 46 is inclined to the plane perpendicular to the plane through which the longitudinal axis 50 of the cutting element 1 extends may be between around 5 degrees to around 30 degrees. In some examples, θ may be between around 10 degrees to around 30 degrees.

In the examples illustrated in FIGS. 1 to 4, spaced-apart projections 44 are arranged in two arrays which are disposed in two substantially circular paths around the central longitudinal axis 50 of the substrate 30. Whilst the projections of the inner array are shown to be closer to the outer array 44 than to the longitudinal central axis 50 of the substrate, in other examples the projections of the inner array may be closer to the longitudinal central axis.

The projections in the second array may be positioned to radially align with the spaces between the projections 44 in the first array. The projections and spaces may be staggered, with projections in one array overlapping spaces in the next array. This staggered or mis-aligned distribution of three-dimensional features on the interface surface may assist in distributing compressive and tensile stresses and/or reducing the magnitude of the stress fields and/or arresting crack growth by preventing an uninterrupted path for crack growth.

As shown in FIGS. 1 to 4, in these examples, the interface surface 42 between the projections 44 is, for example, substantially planar and all or a majority of the projections 44 are shaped such that all or a majority of the surfaces of the projections are not substantially parallel to the cutting face 34 of the super hard material 32 or to the plane through which the longitudinal axis of the substrate extends.

The projections 44 may have a smoothly curving upper surface or may have a sloping upper surface. In some examples, the projections 44 may be slightly trapezoidal or tapered in shape, being widest nearer the interface surface from which they project.

It is believed that such a configuration acts to disturb 'elastic' wave formation in the material and deflect cracks at the interface.

In FIGS. 1 to 4, the projections 44 are spaced substantially equally in/round the respective substantially annular array, with each projection 44 within a given array having the same dimension. However, the projections 44 may be formed in any desired shape, as described above, and spaced apart from each other in a uniform or non-uniform manner to alter the stress fields over the interface surface 38 to form substantially annular concentric discontinuous rings. Furthermore, in some examples the surface the interface surface 42 between the projections 44 is substantially non-planar.

In some examples, the projections 44 are positioned and shaped in such a way that they inhibit one or more continuous paths along which cracks could propagate across the interface surface 38.

The arrangement and shape of the projections 44 and spaces therebetween may affect the stress distributions in the cutting element 1 and may act to improve the cutting element's resistance to crack growth, in particular crack growth along the interface surface 38, for example by arresting or diverting crack growth across the stress zones in, around and above the projections 44.

As shown in the examples of FIGS. 1 and 3, the depth of super hard material in the region around the central longitudinal axis 50 of the substrate 30 may be substantially the same depth as the depth of the super hard material at the periphery of the super hard material layer 32. This may enable the volume and area of super hard material exposed to the work surface in use not to decrease significantly with wear progression thereby improving the lifespan of the cutter element 1. It may also assist in stiffening the cutter element 1 when loaded in the axial direction. Furthermore, it may assist in decreasing or substantially eliminating the possibility of grooving wear formation during use.

In one or more of the above-described examples, any one or more of the shoulder 52, flange 46 and projections 44 of the interface surface 38 may be formed integrally whilst the substrate 30 is being formed through use of an appropriately shaped mold into which the particles of material to form the substrate are placed. Alternatively, any one or more of the shoulder 52, flange 46 and projections 44 of the interface surface 38 may be created after the substrate 30 has been created or part way through the creation process, for example by a conventional machining process such as EDM or by laser ablation. Similar procedures may be applied to the super hard material layer 32 to create the corresponding shaped interface surface for forming a matching fit with that of the substrate, or such a matching fit may be created in the interface of the super hard material layer by placing the particles of super hard material onto a pre-formed substrate and subjecting the combination to the sintering process such that the matching interface in the super hard material layer is formed during sintering.

The super hard material layer 32 may be attached to the substrate by, for example, conventional brazing techniques or by sintering using a conventional high pressure and high temperature technique.

The durability of the cutter product including the substrate and super hard material layer with the aforementioned interface features and/or the mitigation of elastic stress waves therein may be further enhanced if the super hard material layer 32 is leached of catalyst material, either partially or fully, in subsequent processing, or subjected to a further high pressure high temperature sintering process. The leaching may be performed whilst the super hard material layer 32 is attached to the substrate or, for example, by detaching the super hard material layer 32 from the substrate, and leaching the detached super hard material layer 32. In the latter case, after leaching has taken place, the super hard material layer 32 may be reattached to the substrate using, for example, brazing techniques or by resintering using a high pressure and high temperature technique.

Although particular examples have been described and illustrated, it is to be understood that various changes and modifications may be made. For example, the substrate described herein has been identified by way of example. It should be understood that the super hard material may be attached to other carbide substrates besides tungsten carbide substrates, such as substrates made of carbides of W, Ti, Mo, Nb, V, Hf, Ta, and Cr. Furthermore, although the examples shown in FIGS. 1 to 4 are depicted in these drawings as comprising PCD structures having sharp edges and corners, examples may comprise PCD structures having rounded, bevelled or chamfered edges or corners. Such examples may reduce internal stress and consequently extend working life through improving the resistance to cracking, chipping, and fracturing of cutting elements through the interface of the substrate or the super hard material layer having unique geometries.

The invention claimed is:

1. A super hard construction comprising:

a substrate comprising a peripheral surface, an interface surface and a longitudinal axis extending in a plane; and a super hard material layer formed over the substrate and having an exposed outer surface, a peripheral surface extending therefrom and an interface surface;

wherein the interface surface of the substrate comprises:

one or more projections arranged to project from the interface surface in a first direction along the longitudinal axis; the one or more projections being spaced from the peripheral surface of the substrate; and a peripheral flange extending between a peripheral side edge and the interface surface, the peripheral flange being inclined at an angle of between around 5 degrees to around 30 degrees to a plane substantially perpendicular to the plane through which the longitudinal axis extends and directed away from the plane substantially perpendicular to the plane through which the longitudinal axis extends in a second direction opposite the first direction; wherein the flange is spaced from the peripheral side edge by a shoulder portion, the shoulder portion extending a radial distance of between around 0.2 to around 0.8 mm from the peripheral side edge in a plane substantially perpendicular to the plane through which the longitudinal axis of the substrate extends.

2. The super hard construction of claim 1, wherein the peripheral flange is substantially concentric with the substrate.

3. The super hard construction of claim 1, wherein the thickness of the super hard material layer about the longitudinal axis of the substrate is substantially the same as the thickness of the super hard material layer at the peripheral surface.

4. The super hard construction of claim 1, wherein the super hard material layer comprises polycrystalline diamond.

5. The super hard construction of claim 1, wherein the shoulder portion extends a radial distance of between around 0.3 to around 0.5 mm from the peripheral side edge in the plane substantially perpendicular to the plane through which the longitudinal axis of the substrate extends.

6. The super hard construction of claim 1, wherein the interface surface of the substrate is a negative or reversal of the interface surface of the super hard material layer such that the two interface surfaces form a matching fit.

7. The super hard construction of claim 1, wherein the super hard construction is a cutter element.

8. The super hard construction of claim 1, wherein the projections are arranged such that there is reflective symmetry along a plane through the longitudinal axis.

9. The super hard construction of claim 1, the angle at which the peripheral flange is inclined to the plane substantially perpendicular to the plane through which the longitudinal axis extends is between around 5 degrees to around 20 degrees.

10. The super hard construction of claim 1, the angle at which the peripheral flange is inclined to the plane substantially perpendicular to the plane through which the longitudinal axis extends is between around 5 degrees to around 15 degrees.

11. The super hard construction of claim 1, the angle at which the peripheral flange is inclined to the plane substantially perpendicular to the plane through which the longitudinal axis extends is between around 5 degrees to around 10 degrees.

12. The super hard construction of claim 1, wherein the one or more projections are arranged in two arrays disposed in two concentric and substantially circular paths.

13. The super hard construction of claim 12, wherein the one or more projections of a first array are arranged staggered with the one or more projections of a second array.

14. The super hard construction of claim 1, wherein the interface surface is substantially planar and the one or more projections each have a non-parallel surface opposite the interface surface.

15. The super hard construction of claim 14, wherein each non-parallel surface of the one or more projections is not substantially parallel to a cutting face.

16. The super hard construction of claim 1, wherein the one or more projections are each trapezoidal in shape.

17. An earth boring drill bit comprising a body having the super hard construction of claim 1 mounted thereon as a cutter element.

* * * * *